US008784730B2

(12) United States Patent
Hattendorf

(10) Patent No.: US 8,784,730 B2
(45) Date of Patent: Jul. 22, 2014

(54) NICKEL-BASED ALLOY

(75) Inventor: Heike Hattendorf, Werdohl (DE)

(73) Assignee: Outokumpu VDM GmbH, Werdohl (DE)

( * ) Notice: Subject to any disclaimer, the term of this patent is extended or adjusted under 35 U.S.C. 154(b) by 27 days.

(21) Appl. No.: 13/700,776

(22) PCT Filed: Jun. 8, 2011

(86) PCT No.: PCT/DE2011/001174

§ 371 (c)(1),
(2), (4) Date: Nov. 29, 2012

(87) PCT Pub. No.: WO2011/160617

PCT Pub. Date: Dec. 29, 2011

(65) Prior Publication Data

US 2013/0078136 A1 Mar. 28, 2013

(30) Foreign Application Priority Data

Jun. 21, 2010 (DE) ..... 10 2010 024 488

(51) Int. Cl.

| | |
|---|---|
| ***C22C 19/05*** | (2006.01) |
| ***C22C 19/03*** | (2006.01) |
| ***H01T 13/39*** | (2006.01) |

(52) U.S. Cl.

CPC ..... *H01T 13/39* (2013.01); *C22C 19/03* (2013.01); *C22C 19/058* (2013.01); *C22C 19/057* (2013.01)

USPC ..... 420/443; 420/445; 420/451

(58) Field of Classification Search

USPC ..... 420/443, 445, 451

See application file for complete search history.

(56) References Cited

U.S. PATENT DOCUMENTS

| | | | | |
|---|---|---|---|---|
| 4,329,174 | A | 5/1982 | Ito et al. | |
| 5,059,257 | A | 10/1991 | Wanner et al. | |
| 2004/0013560 | A1 | 1/2004 | Hrastnik | |
| 2010/0003163 | A1 * | 1/2010 | Kloewer et al. | 420/443 |

FOREIGN PATENT DOCUMENTS

| | | | |
|---|---|---|---|
| DE | 16 08 116 | A | 12/1970 |
| DE | 29 36 312 | | 3/1980 |
| DE | 102 24 891 | | 12/2003 |
| DE | 10 2006 035 111 | | 2/2008 |
| EP | 1 867 739 | | 12/2007 |
| GB | 943141 | A | 11/1936 |

OTHER PUBLICATIONS

International Search Report of PCT/DE2011/001174, date of mailing Jan. 25, 2012.

Drähte von ThyssenKrupp VDM Automobilindustrie, [Wire from ThyssenKrupp VDM Automotive Industry] Publication N 581, Jan. 2006 Edition. Spec., p. 4.

* cited by examiner

*Primary Examiner* — Keith Walker
*Assistant Examiner* — Alexander Polyansky
(74) *Attorney, Agent, or Firm* — Collard & Roe, P.C.

(57) ABSTRACT

Nickel-based alloy consisting of (in % by mass) Si 0.8-2.0%, Al 0.001-0.1%, Fe 0.01-0.2%, C 0.001-0.10%, N 0.0005-0.10%, Mg 0.0001-0.08%, O 0.0001-0.010%, Mn max. 0.10%, Cr max. 0.10%, Cu max. 0.50%, S max. 0.008%, balance Ni and the usual production-related impurities.

23 Claims, 4 Drawing Sheets

NICKEL-BASED ALLOY

CROSS REFERENCE TO RELATED APPLICATIONS

This application is the National Stage of PCT/DE2011/001174 filed on Jun. 8, 2011, which claims priority under 35 U.S.C. §119 of German Application No. 10 2010 024 488.0 filed on Jun. 21, 2010, the disclosure of which is incorporated by reference. The international application under PCT article 21(2) was not published in English.

BACKGROUND OF THE INVENTION

1. Field of the Invention

The invention relates to a nickel-based alloy.

2. Description of the Related Art

Nickel-based alloys are used, among other things, for producing electrodes of ignition elements for internal combustion engines. These electrodes are exposed to temperatures between 400° C. and 950° C. In addition, the atmosphere alternates between reducing and oxidizing conditions. This produces material destruction or a material loss caused by high-temperature corrosion in the surface region of the electrodes. The production of the ignition spark leads to further stress (spark erosion). Temperatures of several 1000° C. occur at the foot point of the ignition spark, and in the event of a break-through, currents of up to 100 A flow during the first nanoseconds. At every spark-over, a limited material volume in the electrodes is melted and partly evaporated, and this produces a material loss.

In addition, vibrations of the engine increase the mechanical stresses.

An electrode material should have the following properties:

- good resistance to high-temperature corrosion, particularly oxidation, but also sulfidation, carburization, and nitration;
- resistance to the erosion that occurs as the result of the ignition spark;
- the material should not be sensitive to thermal shocks and should be heat-resistant;
- the material should have good heat conductivity, good electrical conductivity, and a sufficiently high melting point;
- the material should be easy to process and inexpensive.

Nickel alloys, in particular, have a good potential for fulfilling this spectrum of properties. They are inexpensive in comparison with precious metals, they do not demonstrate any phase conversions up to the melting point, like cobalt or iron, they are comparatively non-sensitive to carburization and nitration, they have good heat resistance and good corrosion resistance, and they can be deformed well and welded.

Wear caused by high-temperature corrosion can be determined by means of mass change measurements as well as by means of metallographic studies after aging at predetermined test temperatures.

For both damage mechanisms, high-temperature corrosion and spark erosion, the type of oxide layer formation is of particular significance.

In order to achieve an optimal oxide layer formation for the concrete application case, various alloy elements are known in the case of nickel-based alloys.

In the following, all the concentration information is given in % by mass unless explicitly noted otherwise.

From DE 29 36 312, a nickel alloy has become known, consisting of about 0.2 to 3% Si, about 0.5% or less Mn, at least two metals, selected from the group consisting of about 0.2 to 3% Cr, about 0.2 to 3% Al, and about 0.01 to 1% Y, remainder nickel.

In DE-A 102 24 891 A1, an alloy on the basis of nickel is proposed, which has 1.8 to 2.2% silicon, 0.05 to 0.1% yttrium and/or hafnium and/or zirconium, 2 to 2.4% aluminum, remainder nickel. Such alloys can be worked only under difficult conditions, with regard to the high aluminum and silicon contents, and are therefore not very suitable for technical large-scale use.

In EP 1 867 739 A1, an alloy on the basis of nickel is proposed, which contains 1.5 to 2.5% silicon, 1.5 to 3% aluminum, 0 to 0.5% manganese, 0.5 to 0.2% titanium in combination with 0.1 to 0.3% zirconium, whereby the zirconium can be replaced, in whole or in part, by double the mass of hafnium.

In DE 10 2006 035 111 A1, an alloy on the basis of nickel is proposed, which contains 1.2 to 2.0% aluminum, 1.2 to 1.8% silicon, 0.001 to 0.1% carbon, 0.001 to 0.1% sulfur, maximally 0.1% chromium, maximally 0.01% manganese, maximally 0.1% Cu, maximally 0.2% iron, 0.005 to 0.06% magnesium, maximally 0.005% lead, 0.05 to 0.15% Y, and 0.05 to 0.10% hafnium or lanthanum or 0.05 to 0.10% hafnium and lanthanum, in each instance, remainder nickel, and production-related contaminants.

In the brochure "Drähte von ThyssenKrupp VDM Automobilindustrie" Publication N 581, Jan. 2006 Edition, on page 18, an alloy according to the state of the art is described, NiCr2MnSi with 1.4 to 1.8% Cr, max. 0.3% Fe, max. 0.5% C, 1.3 to 1.8% Mn, 0.4 to 0.65% Si, max. 0.15% Cu, and max. 0.15% Ti. As an example, a batch T1 of this alloy is indicated in Table 1. Furthermore, in Table 1, the batch T2 is indicated, which was melted according to DE 2936312 with 1% Si, 1% Al, and 0.17% Y. An oxidation test at 900° C. in air was conducted on these alloys, whereby the test was interrupted every 96 hours and the mass change in the samples caused by oxidation was determined (net mass change). FIG. 1 shows that T1 has a negative mass change from the start. In other words, parts of the oxide that formed during oxidation have flaked off from the sample, so that the mass loss caused by flaking of oxide is greater than the mass increase caused by oxidation. This is disadvantageous, because the protective layer formation at the flaked-off locations must always begin anew. The behavior of T2 is more advantageous. There, the mass increase caused by oxidation predominates during the first 192 hours. Only afterwards is the mass increase caused by flaking greater than the mass increase caused by oxidation, whereby the mass loss of T2 is clearly less than that of T1. In other words, a nickel alloy with approx. 1% Si, approx. 1% Al, and 0.17% Y demonstrates clearly more advantageous behavior than a nickel alloy with 1.6% Cr, 1.5% Mn, and 0.5% Si.

SUMMARY OF THE INVENTION

It is the goal of the object of the invention to make available a nickel alloy that leads to an increase in the lifetime of components produced from it, which can be brought about by means of increasing the spark erosion resistance and corrosion resistance, with simultaneous good deformability and weldability (workability).

The goal of the object of the invention is achieved by means of a nickel-based alloy containing (in % by mass)

Si 0.8-2.0%
Al 0.001 to 0.10%
Fe 0.01 to 0.20%
C 0.001-0.10%

N 0.0005-0.10%
Mg 0.0001-0.08%
O 0.0001 to 0.010%
Mn max. 0.10%
Cr max. 0.10%
Cu max. 0.50%
S max. 0.008%
Ni remainder, and the usual production-related contaminants.

Preferred embodiments of the object of the invention can be derived from the dependent claims.

Surprisingly, it has been shown that the addition of silicon is more advantageous for the spark erosion resistance and corrosion resistance than the addition of aluminum.

The silicon content lies between 0.8 and 2.0%, whereby preferably defined contents within the spread ranges can be adjusted:

0.8 to 1.5% or 0.8 to 1.2%

This holds true in the same manner for the element aluminum, which is adjusted in contents between 0.001 to 0.10%. Preferred contents can be present as follows:

0.001 to 0.05%

This holds true likewise for the element iron, which is adjusted in contents between 0.01 to 0.20%. Preferred contents can be present as follows:

0.01 to 0.10% or 0.01 to 0.05%

Carbon is adjusted in the alloy in the same manner, specifically in contents between 0.001-0.10%. Preferably, contents can be adjusted in the alloy as follows:

0.001 to 0.05%

Nitrogen is adjusted in the alloy likewise, specifically in contents between 0.0005-0.10%. Preferably, contents can be adjusted in the alloy as follows:

0.001 to 0.05%

Magnesium is adjusted in contents 0.0001 to 0.08%. Preferably, the possibility exists of adjusting this element in the alloy as follows:

0.005 to 0.08%

The alloy can furthermore contain calcium in contents between 0.0002 and 0.06%.

The oxygen content is adjusted in the alloy with a content of 0.0001 to 0.010%. Preferably, the following content of oxygen can be adjusted:

0.0001 to 0.008%

The elements Mn and Cr can be present in the alloy as follows:

Mn max. 0.10%

Cr max. 0.10%.

whereby preferably, the following ranges exist:

Mn>0 to max. 0.05%

Cr>0 to max. 0.05%.

Furthermore, it is advantageous to add yttrium to the alloy with a content of 0.03% to 0.20%, whereby a preferred range is:

0.05 to 0.15%

Another possibility is to add hafnium to the alloy with a content of 0.03% to 0.25%, whereby a preferred range is:

0.03 to 0.15%

Likewise, zirconium can be added to the alloy with a content of 0.03 to 0.15.

The addition of cerium with a content of 0.03 to 0.15 is also possible.

Furthermore, lanthanum can be added with a content of 0.03 to 0.15%.

The alloy can contain Ti with a content of up to max. 0.15%.

The copper content is restricted to max. 0.50%; preferably, it lies at max. 0.20%.

Finally, the elements cobalt, tungsten, molybdenum, and lead can also be present as contaminants, in contents as follows:

Co max. 0.50%
W max. 0.10%
Mo max. 0.10%
Pb max. 0.005%
Zn max. 0.005%

The nickel-based alloy according to the invention can preferably be used as a material for electrodes of ignition elements of internal combustion engines, particularly of spark plugs for gasoline engines.

BRIEF DESCRIPTION OF THE DRAWINGS

FIG. 2 is a graph showing amount of flaking in the

The object of the invention will be explained in greater detail using the following examples. oxidation test at 900° C. in the batches from Tables 2 and 3.

Figure 3:
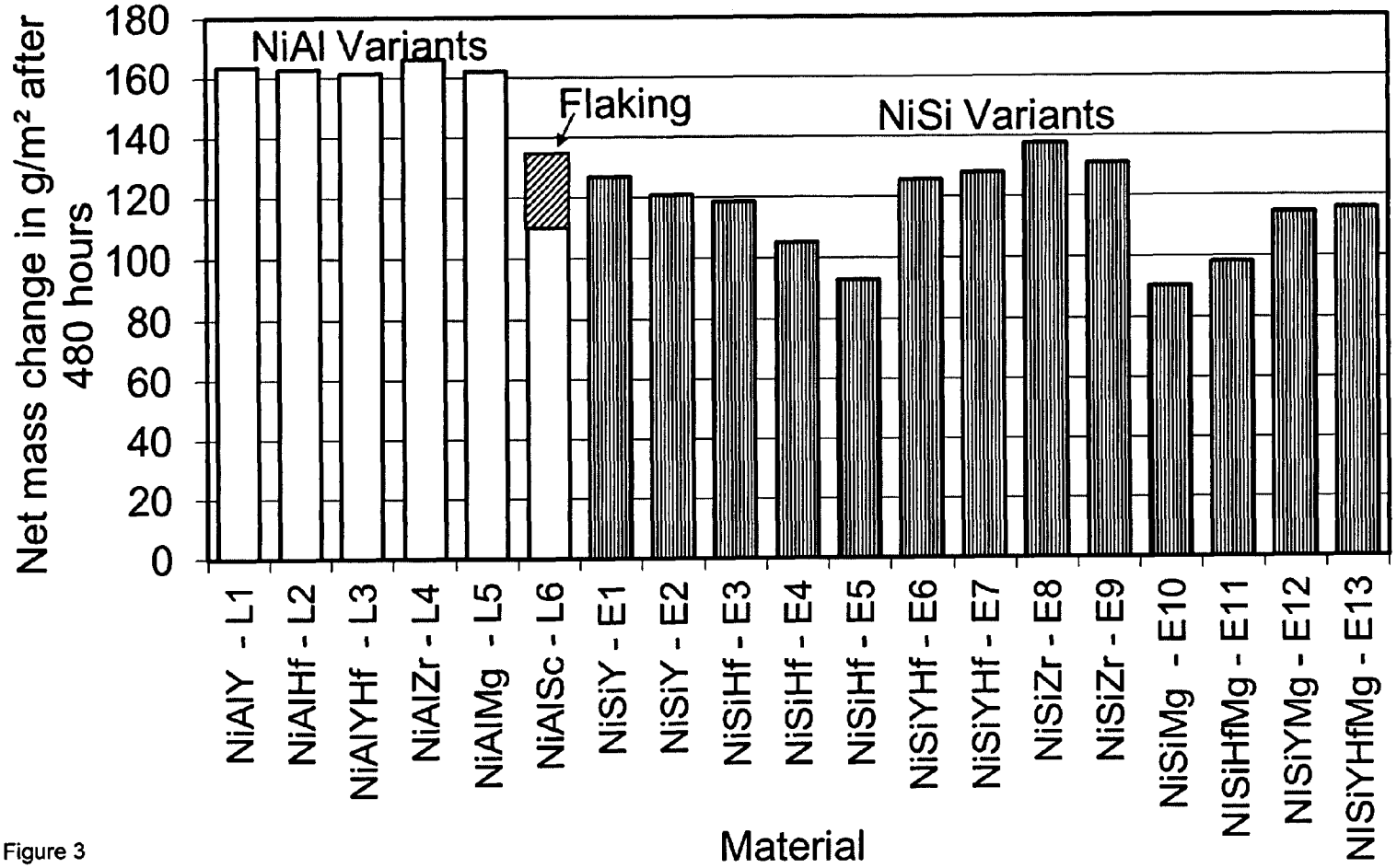

FIG. 3 is a graph showing net mass change in the oxidation test at 900° C. in the batches according to the state of the art from Tables 2 and 3.

DETAILED DESCRIPTION OF THE PREFERRED EMBODIMENTS

The object of the invention will be explained in greater detail using the following examples.

EXAMPLES

Table 1 shows alloy compositions that belong to the state of the art.

In Table 2, examples of nickel alloys not according to the invention, with 1% aluminum and various contents of elements with oxygen affinity are shown: L1 contains 0.13% Y, L2 0.18% Hf, L3 0.12% Y and 0.20 Hf, L4 0.13% Zr, L5 0.043% Mg, and L6 0.12% Sc. Furthermore, these batches contain different oxygen contents in the range of 0.001% to 0.004% and Si contents<0.01%.

In Table 3, examples of nickel alloys according to the invention are shown, with approx. 1% silicon and various contents of elements with oxygen affinity: E1 and E2 contain approx. 0.1% Y, in each instance, E3, E4, and E5 contain approx. 0.20% Hf, in each instance, E6 and E7 contain approx. 0.12% Y and 0.14 or 0.22 Hf, in each instance, E8 and E9 contain approx. 0.10% Zr, in each instance, E10 0.037% Mg, E11 contains 0.18% Hf and 0.055% Mg, E12 contains 0.1% Y and 0.065% Mg, and E13 0.11% Y and 0.19% Hf and 0.059% Mg. Furthermore, these batches contain various oxygen contents in the range of 0.002% to 0.007%, and Al contents between 0.003 and 0.035%.

An oxidation test at 900° C. in air was conducted on these alloys, as well as on the alloys in Table 1, whereby the test was interrupted every 24 hours and the mass change of the samples caused by oxidation was determined (net mass change $m_N$). In these tests, the samples were in ceramic crucibles, so that any oxides that flaked off were collected. By weighing the crucible before the test ($m_T$) and weighing the crucible with the collected flakes and the sample ($m_G$) when the test was interrupted, in each instance, it is possible to determine the amount of the flaked-off oxides ($m_A$) together with the net mass change.

$$m_A = m_G - m_T - m_N$$

Figure 1:
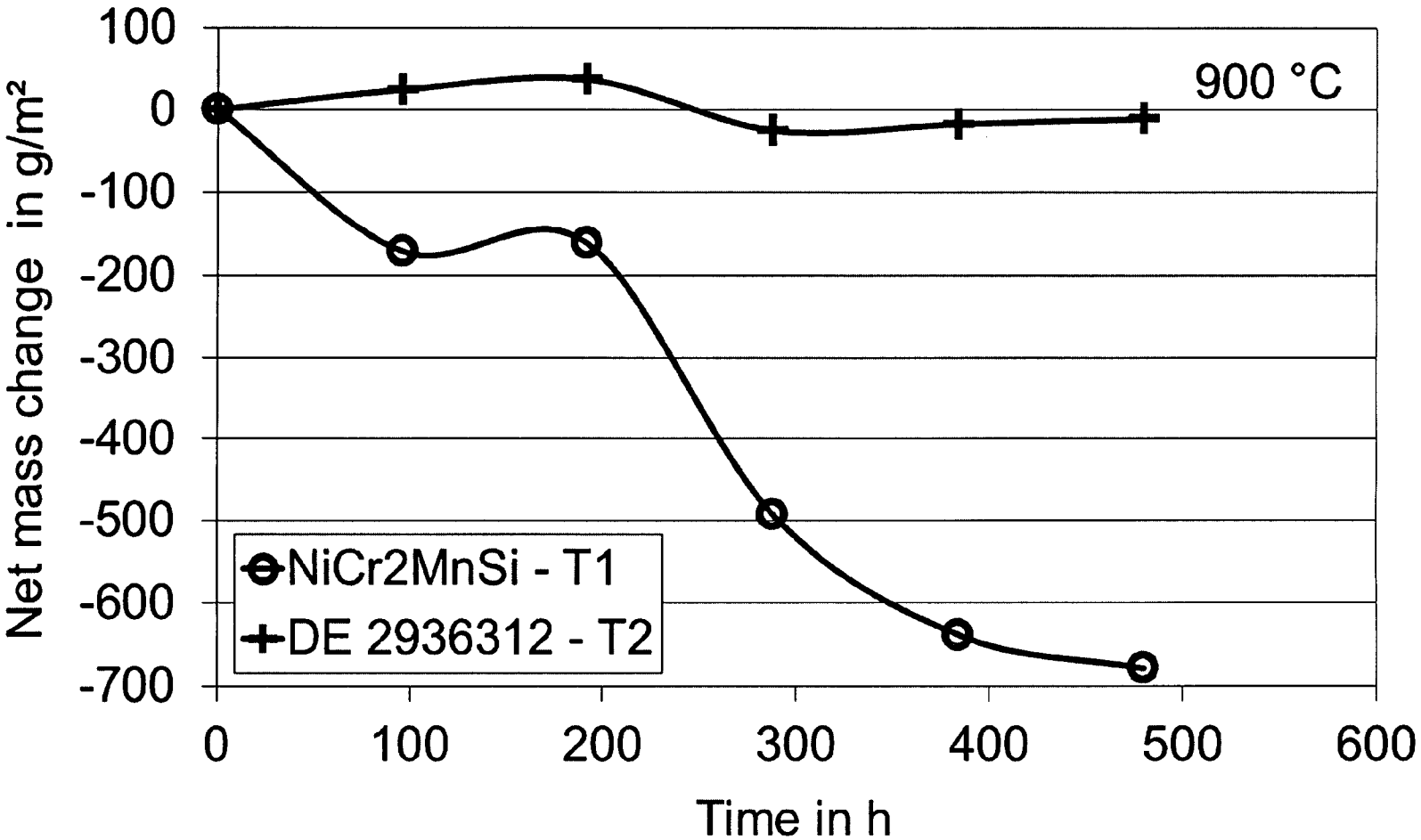
FIG. 1 is a graph showing net mass change in the oxidation test at 900° C. in the batches according to the state of the art from Table 1;.
Figure 2A:
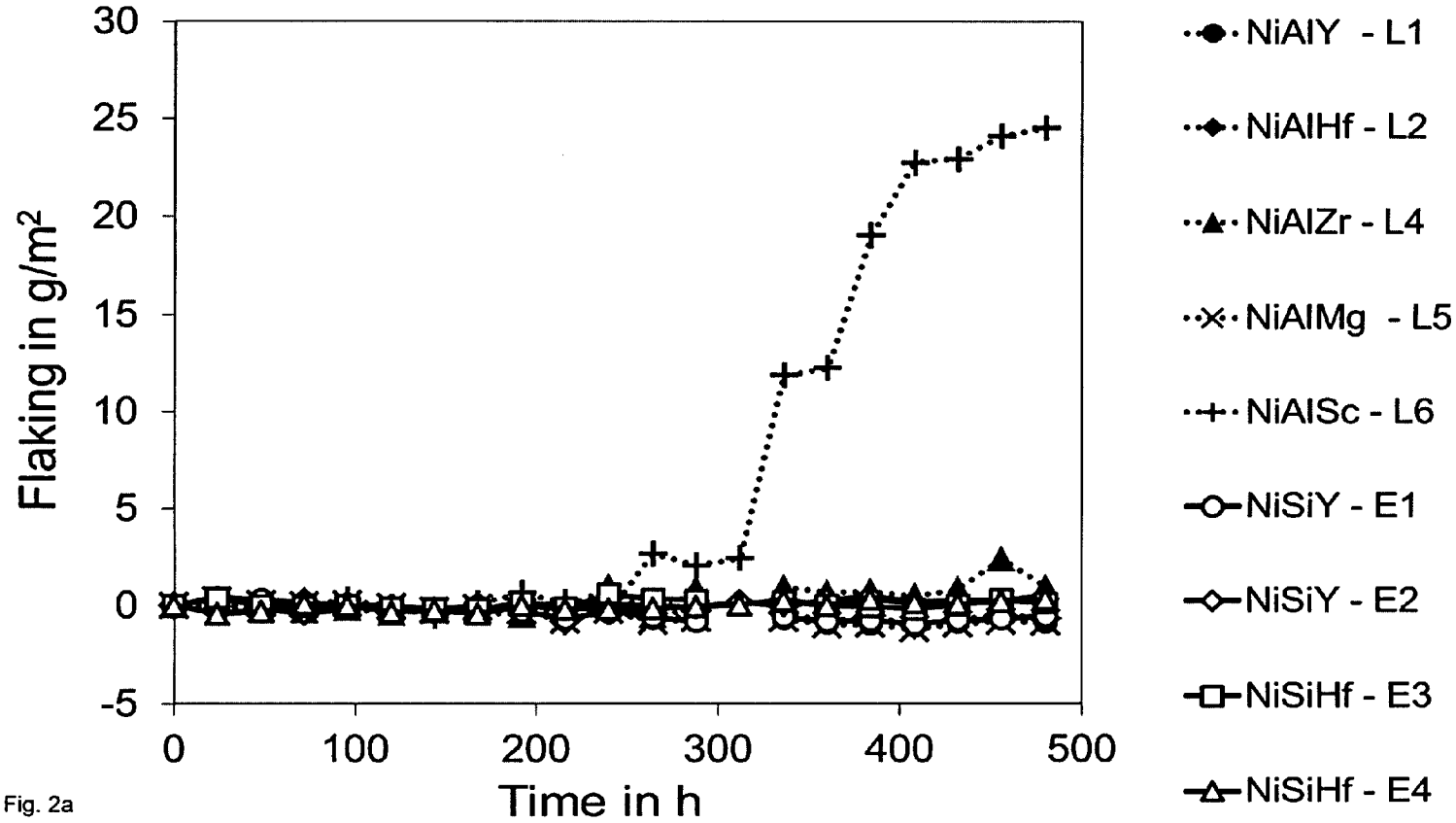
Figure 2B:
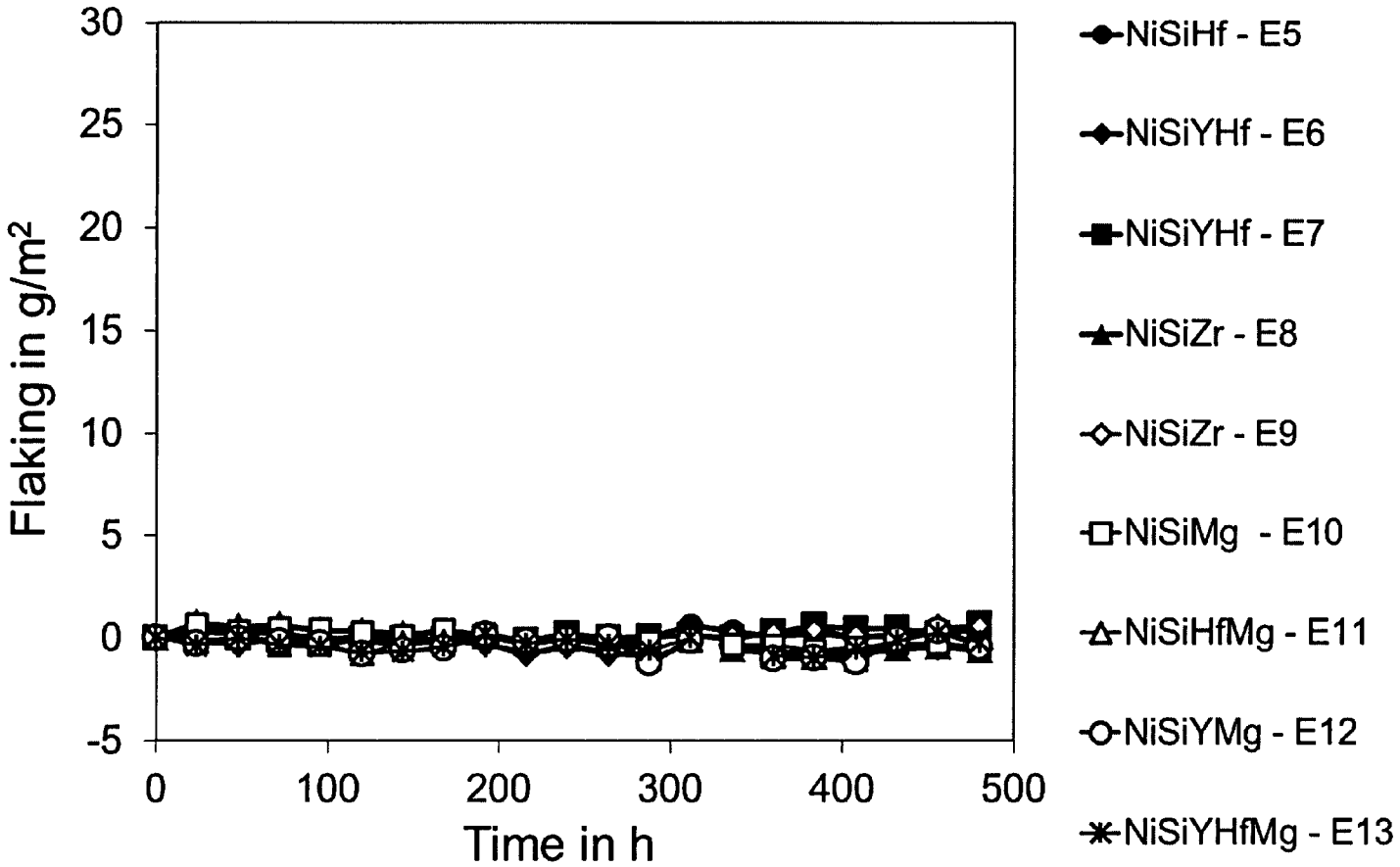

In this connection, it has been shown that all the batches from Table 2 and 3, except for the batch L6, which contained Sc, do not show any flaking (FIG. 2). This is a clear improvement as compared with the state of the art from Table 1 and FIG. 1. FIG. 3 shows the net mass change for all batches from Tables 2 and 3, whereby the mass change caused by flaking was additionally entered for batch L6.

FIG. 3 shows that the alloys containing 1% Al all have a greater mass increase caused by oxidation than the alloys containing 1% Si from Table 3. For this reason, the aluminum content is restricted, according to the invention, to max. 0.10%. An overly low Al content increases the costs. The Al content is therefore greater than or equal to 0.001%

As can be seen in FIG. 3, the NiSi alloys with Mg (E10) demonstrate a particularly slight increase in mass, i.e. a particularly good oxidation resistance. In other words, Mg improves the oxidation resistance of the melts that contain Si. Furthermore, none of the alloys that contain Si demonstrate any flaking in FIG. 3, in contrast to the alloys in FIG. 1. This also means that Y, Hf, and Zr, to the extent that they are added in sufficient amounts, also improve the oxidation resistance, although partly with a slightly increased oxidation rate in comparison with Mg. The alloys that contain Al also do not demonstrate any flaking, because of the additions of Y, Hf and/or Zr, except for the alloy LB2174, which contains Sc, but rather only an increased oxidation rate in comparison with the alloys that contain Si.

The reasons for the claimed limits for the alloy can therefore be stated in detail as follows:

A minimum content of 0.8% Si is necessary in order to obtain the oxidation resistance and the increasing effect of the Si. At greater Si contents, workability worsens. The upper limit is therefore established at 2.0% by weight Si.

Aluminum worsens the oxidation resistance when added in the range of 1%. For this reason, the aluminum content is restricted to max. 0.10%. An overly low Al content increases the costs. The Al content is therefore established at greater than or equal to 0.001%.

Iron is limited to 0.20%, because this element reduces the oxidation resistance. An overly low Fe content increases the costs in the production of the alloy. The Fe content is therefore greater than or equal to 0.01%.

The carbon content should be less than 0.10%, in order to guarantee workability. Overly low C contents cause increased costs in the production of the alloy. The carbon content should therefore be greater than 0.001%.

Nitrogen is limited to 0.10%, because this element reduces the oxidation resistance. Overly low N contents cause increased costs in the production of the alloy. The nitrogen content should therefore be greater than 0.0005%.

As FIG. 3 shows, the NiSi alloy with Mg (E10) has a particularly low increase in mass, i.e. a particularly good oxidation resistance, so that a Mg content is advantageous. Even very slight Mg contents already improve processing, by means of binding sulfur, thereby preventing the occurrence of NiS eutectics, which have a low melting point. For Mg, a minimum content of 0.0001% is therefore required. At overly high contents, intermetallic Ni—Mg phases can occur, which again clearly worsen the workability. The Mg content is therefore limited to 0.08%.

The oxygen content must be less than 0.010% to guarantee the producibility of the alloy. Overly low oxygen contents cause increased costs. The oxygen content should therefore be greater than 0.0001%.

Manganese is limited to 0.1%, because this element reduces the oxidation resistance.

Chromium is limited to 0.10%, because this element, as the example of T1 in FIG. 1 shows, is not advantageous.

Copper is limited to 0.50%, because this element reduces the oxidation resistance.

The contents of sulfur should be kept as low as possible, because this surfactant element impairs the oxidation resistance. For this reason, max. 0.008% S is established.

Just like Mg, even very slight Ca contents already improve processing, by means of binding sulfur, thereby preventing the occurrence of NiS eutectics with a low melting point. For this reason, a minimum content of 0.0002% is therefore required for Ca. At overly high contents, intermetallic Ni—Ca phases can occur, which again clearly worsen the workability. The Ca content is therefore limited to 0.06%.

A minimum content of 0.03% Y is necessary in order to obtain the effect of the Y of increasing the oxidation resistance. The upper limit is placed at 0.20% for cost reasons.

A minimum content of 0.03% Hf is necessary in order to obtain the effect of the Hf of increasing the oxidation resistance. The upper limit is placed at 0.25% Hf for cost reasons.

A minimum content of 0.03% Zr is necessary in order to obtain the effect of the Zr of increasing the oxidation resistance. The upper limit is placed at 0.15% Zr for cost reasons.

A minimum content of 0.03% Ce is necessary in order to obtain the effect of the Ce of increasing the oxidation resistance. The upper limit is placed at 0.15% Ce for cost reasons.

A minimum content of 0.03% La is necessary in order to obtain the effect of the La of increasing the oxidation resistance. The upper limit is placed at 0.15% La for cost reasons.

The alloy can contain up to 0.15% Ti without its properties becoming worse.

Cobalt is limited to max. 0.50% because this element reduces the oxidation resistance.

Molybdenum is limited to max. 0.10% because this element reduces the oxidation resistance. The same holds true also for tungsten and also for vanadium.

The content of phosphorus should be less than 0.020%, because this surfactant element impairs the oxidation resistance.

The content of boron should be kept as low as possible, because this surfactant element impairs the oxidation resistance. For this reason, max. 0.005% B is established.

Pb is limited to max. 0.005%, because this element reduces the oxidation resistance. The same holds true for Zn.

TABLE 1

Composition of alloys according to the state of the art
[decimal commas = decimal periods]

| | NiCr2MnSi-2.4146 | DE 2936312 |
|---|---|---|
| Batch<br>Element | T1 | T2 |
| Ni | Remainder | Remainder |
| Si | 0.5 | 1.0 |
| Al | — | 1.0 |
| Y | — | 0.17 |
| Ti | 0.01 | — |
| C | 0.003 | — |
| Co | 0.04 | — |
| Cu | 0.01 | 0.01 |

TABLE 1-continued

Composition of alloys according to the state of the art [decimal commas = decimal periods]

| | NiCr2MnSi-2.4146 | DE 2936312 |
|---|---|---|
| Cr | 1.6 | 0.01 |
| Mn | 1.5 | 0.02 |
| Fe | 0.08 | 0.13 |

TABLE 2

Analyses of the batches containing approx. 1% Al (batches not according to the invention)

| Material | NiAlY | NiAlHf | NiAlYHf | NiAlZr | NiAlMg | NiAlSc |
|---|---|---|---|---|---|---|
| Charge | L1 | L2 | L3 | L4 | L5 | L6 |
| C | 0.003 | 0.002 | 0.002 | 0.002 | 0.002 | 0.003 |
| S | <0.0006 | <0.0005 | 0.0005 | 0.0005 | 0.0009 | 0.0005 |
| N | 0.002 | 0.002 | <0.001 | 0.003 | <0.001 | <0.002 |
| Cr | 0.01 | 0.01 | 0.01 | 0.01 | <0.01 | 0.01 |
| Ni (Rest) | 98.5 | 98.6 | 98.5 | 98.5 | 98.7 | 98.7 |
| Mn | <0.01 | 0.01 | <0.01 | <0.01 | <0.01 | <0.01 |
| Si | <0.01 | <0.01 | <0.01 | <0.01 | <0.01 | <0.02 |

TABLE 2-continued

Analyses of the batches containing approx. 1% Al (batches not according to the invention)

| Material | NiAlY | NiAlHf | NiAlYHf | NiAlZr | NiAlMg | NiAlSc |
|---|---|---|---|---|---|---|
| Cu | <0.01 | <0.01 | <0.01 | <0.01 | <0.01 | <0.01 |
| Fe | 0.02 | 0.02 | 0.02 | 0.05 | 0.03 | 0.02 |
| P | 0.002 | 0.004 | 0.003 | 0.002 | <0.002 | <0.005 |
| Al | 0.94 | 0.94 | 0.95 | 0.94 | 0.96 | 1.13 |
| Mg | 0.0004 | 0.0007 | 0.0005 | 0.0004 | 0.043 | 0.0001 |
| Pb | <0.001 | 0.001 | <0.001 | <0.001 | <0.001 | |
| O | 0.0030 | 0.0030 | 0.0020 | 0.0010 | 0.0040 | 0.0020 |
| Ca | 0.0002 | 0.0002 | 0.0002 | 0.0004 | 0.0002 | 0.0003 |
| C | 0.0002 | 0.0002 | 0.0002 | 0.0004 | 0.0002 | 0.0003 |
| V | <0.01 | <0.01 | <0.01 | <0.01 | <0.01 | <0.01 |
| W | <0.01 | <0.01 | <0.01 | <0.01 | <0.01 | <0.01 |
| Zr | 0.004 | 0.016 | 0.012 | 0.13 | 0.009 | <0.001 |
| Co | 0.01 | 0.01 | 0.01 | 0.01 | 0.01 | 0.01 |
| Y | 0.13 | <0.001 | 0.12 | <0.001 | <0.001 | <0.001 |
| B | 0.001 | 0.001 | <0.001 | 0.001 | <0.001 | 0.001 |
| Hf | 0.002 | 0.18 | 0.20 | 0.001 | 0.001 | <0.001 |
| Ce | | | | | | <0.001 |
| Sc | <0.001 | <0.001 | <0.001 | <0.001 | <0.001 | 0.12 |

Charge = batch
Rest = Remainder
[decimal commas = decimal periods]

TABLE 3

Analyses of the batches containing approx. 1% Si and <0.05% Al (batches according to the invention)

| Material | NiSiY | NiSiY | NiSiHf | NiSiHf | NiSiHf | NiSiYHf | NiSiYHf | NiSiZr | NiSiZr | NiSiMg | NiSiHfMg | NiSiYMg | NiSiYHfMg |
|---|---|---|---|---|---|---|---|---|---|---|---|---|---|
| Charge | E1 | E2 | E3 | E4 | E5 | E6 | E7 | E8 | E9 | E10 | E11 | E12 | E13 |
| C | 0.004 | 0.002 | 0.005 | 0.0015 | 0.008 | 0.004 | 0.002 | 0.002 | 0.0015 | 0.003 | 0.005 | 0.002 | 0.0019 |
| S | 0.0011 | 0.0005 | 0.0008 | <0.0005 | <0.0005 | 0.0006 | 0.0005 | 0.0015 | 0.0005 | 0.0014 | 0.0024 | 0.0008 | <0.0005 |
| N | 0.001 | <0.002 | <0.001 | <0.002 | 0.002 | 0.002 | 0.002 | 0.001 | <0.002 | 0.001 | <0.001 | <0.001 | <0.001 |
| Cr | <0.01 | <0.01 | <0.01 | 0.01 | 0.01 | 0.01 | 0.01 | 0.01 | 0.01 | 0.01 | <0.01 | 0.01 | <0.01 |
| Ni | 98.76R | 98.67R | 98.80R | 98.76R | 98.75R | 98.74R | 98.67R | 98.73R | 98.61R | 98.83R | 98.70R | 98.54R | 98.55R |
| Mn | <0.01 | <0.01 | <0.01 | <0.01 | 0.01 | <0.01 | 0.01 | <0.01 | <0.01 | <0.01 | <0.01 | 0.01 | <0.01 |
| Si | 0.98 | 1.08 | 1.07 | 1.09 | 1.00 | 0.98 | 1.1 | 1.02 | 1.11 | 1.00 | 0.98 | 1.04 | 1.03 |
| Mo | <0.01 | <0.01 | <0.01 | <0.01 | 0.01 | <0.01 | 0.01 | 0.01 | 0.01 | <0.01 | <0.01 | <0.01 | <0.01 |
| Ti | <0.01 | <0.01 | 0.01 | <0.01 | 0.01 | 0.01 | <0.01 | 0.01 | 0.01 | 0.01 | 0.01 | <0.01 | <0.01 |
| Nb | <0.01 | <0.01 | <0.01 | <0.01 | 0.01 | <0.01 | <0.01 | <0.01 | <0.01 | <0.01 | 0.01 | <0.01 | <0.01 |
| Cu | <0.01 | <0.01 | <0.01 | <0.01 | 0.01 | <0.01 | 0.01 | <0.01 | <0.01 | <0.01 | <0.01 | <0.01 | <0.01 |
| Fe | 0.02 | 0.02 | 0.02 | 0.02 | 0.02 | 0.02 | 0.02 | 0.04 | 0.05 | 0.02 | 0.03 | 0.03 | 0.03 |
| P | <0.002 | 0.002 | <0.002 | <0.002 | 0.002 | <0.002 | 0.002 | <0.002 | <0.002 | <0.002 | 0.002 | <0.002 | <0.002 |
| Al | 0.035 | 0.025 | 0.021 | 0.003 | 0.005 | 0.04 | 0.027 | 0.01 | 0.006 | 0.009 | 0.008 | 0.020 | 0.032 |
| Mg | 0.0003 | 0.0016 | 0.0003 | 0.0003 | 0.0001 | 0.0005 | 0.0017 | 0.0002 | 0.0001 | 0.037 | 0.055 | 0.065 | 0.059 |
| Pb | <0.0018 | <0.001 | <0.001 | <0.001 | 0.001 | <0.001 | <0.001 | <0.001 | <0.001 | <0.001 | <0.001 | <0.001 | 0.001 |
| O | 0.0070 | 0.0030 | 0.0060 | 0.0070 | 0.0020 | 0.0060 | 0.0020 | 0.0040 | 0.0060 | 0.0040 | 0.0020 | 0.0020 | 0.0020 |
| Ca | 0.0007 | 0.0003 | 0.0004 | 0.0003 | 0.0005 | 0.0005 | 0.0003 | 0.0008 | 0.0002 | 0.0004 | 0.0002 | 0.0007 | 0.0006 |
| C | 0.0007 | 0.0003 | 0.0004 | 0.0003 | 0.0002 | 0.0005 | 0.0003 | 0.0008 | 0.0002 | 0.0004 | 0.0002 | 0.0007 | 0.0006 |
| V | <0.01 | <0.01 | <0.01 | <0.01 | 0.01 | <0.01 | <0.01 | <0.01 | <0.01 | <0.01 | <0.01 | <0.01 | <0.01 |
| W | <0.01 | <0.01 | | <0.01 | 0.01 | <0.01 | <0.01 | <0.01 | <0.01 | <0.01 | <0.01 | <0.01 | <0.01 |
| Zr | <0.001 | 0.001 | 0.004 | 0.003 | 0.004 | 0.003 | 0.004 | 0.10 | 0.11 | 0.001 | 0.005 | 0.002 | 0.004 |
| Co | 0.01 | 0.01 | 0.01 | 0.01 | 0.01 | 0.01 | 0.01 | 0.01 | 0.01 | 0.01 | 0.01 | 0.01 | 0.01 |
| Y | 0.11 | 0.002 | <0.001 | <0.001 | <0.001 | 0.12 | 0.12 | <0.001 | <0.01 | <0.001 | <0.001 | 0.10 | 0.11 |
| B | 0.001 | <0.001 | <0.001 | <0.001 | 0.001 | <0.001 | <0.001 | <0.001 | 0.001 | <0.001 | <0.001 | <0.001 | 0.001 |
| Hf | <0.001 | <0.001 | 0.18 | 0.19 | 0.20 | 0.14 | 0.22 | <0.001 | <0.001 | <0.001 | 0.16 | | 0.19 |
| Ce | | | | | <0.001 | | | | <0.001 | | <0.001 | <0.001 | <0.001 |
| Sc | <0.001 | <0.001 | <0.001 | <0.001 | | <0.001 | <0.001 | <0.001 | | <0.001 | | | |

Charge = Batch
[decimal commas = decimal periods]

TABLE 2-continued

Analyses of the batches containing approx. 1% Al (batches not according to the invention)

| Material | NiAlY | NiAlHf | NiAlYHf | NiAlZr | NiAlMg | NiAlSc |
|---|---|---|---|---|---|---|
| Mo | <0.01 | <0.01 | <0.01 | 0.01 | <0.01 | <0.01 |
| Ti | <0.01 | <0.01 | <0.01 | <0.01 | <0.01 | <0.01 |
| Nb | <0.01 | <0.01 | <0.01 | <0.01 | <0.01 | <0.01 |

The invention claimed is:

1. A nickel-based alloy, consisting of (in % by mass)

Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Mn max. 0.10%

Cr max. 0.10%
Cu max. 0.50%
S max. 0.008%
Ni remainder, and the usual production-related contaminants.

2. The nickel-based alloy according to claim 1, with a Si content (in % by mass) of 0.8 to 1.5%.

3. The nickel-based alloy according to claim 1, with a Si content (in % by mass) of 0.8 to 1.2%.

4. The nickel-based alloy according to claim 1, with an Al content (in % by mass) of 0.001 to 0.05%.

5. The nickel-based alloy according to claim 1, with an Fe content (in % by mass) of 0.01 to 0.10%.

6. The nickel-based alloy according to claim 1, with an Fe content (in % by mass) of 0.01 to 0.05%.

7. The nickel-based alloy according to claim 1, with a C content (in % by mass) of 0.001 to 0.05% and an N content (in % by mass) of 0.001 to 0.05%.

8. The nickel-based alloy according to claim 1, with a Mg content (in % by mass) of 0.005 to 0.08%.

9. The nickel-based alloy according to claim 1, with a Ca content (in % by mass) of 0.0002 to 0.06%.

10. The nickel-based alloy according to claim 1, with an O content (in % by mass) of 0.0001 to 0.008%.

11. The nickel-based alloy according to claim 1, with a Mn content (in % by mass) of max. 0.05% and with a Cr content (in % by mass) of max. 0.05%.

12. The nickel-based alloy according to claim 1, with a Cu content (in % by mass) of max. 0.20%.

13. An electrode material for an ignition element of an internal combustion engine comprising the nickel-based alloy according to claim 1.

14. The electrode material according to claim 13 wherein the ignition element is a spark plug of a gasoline engine.

15. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Y 0.03 to 0.20%
Mn max. 0.10%
Cr max. 0.10%
Cu max. 0.50%
S max. 0.008%
Ni remainder, and the usual production-related contaminants.

16. The nickel-based alloy according to claim 15, with an Y content (in % by mass) of 0.05 to 0.15%.

17. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Hf 0.03 to 0.25%
Mn max. 0.10%
Cr max. 0.10%
Cu max. 0.50%
S max. 0.008%
Ni remainder, and the usual production-related contaminants.

18. The nickel-based alloy according to claim 17, with a Hf content (in % by mass) of 0.03 to 0.15%.

19. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Zr 0.03 to 0.15%
Mn max. 0.10%
Cr max. 0.10%
Cu max. 0.50%
S max. 0.008%
Ni remainder, and the usual production-related contaminants.

20. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Ce 0.03 to 0.15%
Mn max. 0.10%
Cr max. 0.10%
Cu max. 0.50%
S max. 0.008%
Ni remainder, and the usual production-related contaminants.

21. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
La 0.03 to 0.15%
Mn max. 0.10%
Cr max. 0.10%
Cu max. 0.50%
S max. 0.008%
Ni remainder, and the usual production-related contaminants.

22. A nickel-based alloy, consisting of (in % by mass)
Si 0.8-2.0%
Al 0.001 to 0.1%
Fe 0.01 to 0.2%
C 0.001-0.10%
N 0.0005-0.10%
Mg 0.0001-0.08%
O 0.0001 to 0.010%
Ti max. 0.15%
Mn max. 0.10%
Cr max. 0.10%
Cu max. 0.50%
S max. 0.008%
Ni remainder, and the usual production-related contaminants.

23. A nickel-based alloy, consisting of (in % by mass)
Si 0.8-2.0%
Al 0.001 to 0.1%
Fe 0.01 to 0.2%
C 0.001-0.10%

N 0.0005-0.10%
Mg 0.0001-0.08%
O 0.0001 to 0.010%
Co max. 0.50%
W max. 0.10%
Mo max. 0.10%
V max. 0.10%
P max. 0.020%
B max. 0.005%
Pb max. 0.005%
Zn max. 0.005%
Mn max. 0.10%
Cr max. 0.10%
Cu max. 0.50%
S max. 0.008%
Ni remainder, and the usual production-related contaminants.

* * * * *